United States Patent [19]

Gartland, deceased et al.

[11] 4,215,447

[45] Aug. 5, 1980

[54] PROCESS AND APPARATUS FOR WASHING FIBRE STOCK IN THE DE-INKING OF PAPER

[76] Inventors: William T. Gartland, deceased, late of Hollingbourne, England; by Jean G. Gartland, executor, Pine Cottage, Ashford Rd., Woodcut Hill, Hollingbourne, near Maidstone, Kent, England

[21] Appl. No.: 945,865

[22] Filed: Sep. 26, 1978

[30] Foreign Application Priority Data

Sep. 28, 1977 [GB] United Kingdom ..... 40366/77

[51] Int. Cl.[2] ..... D21C 1/02; D21C 5/02

[52] U.S. Cl. ..... 8/156; 68/181 R; 162/4; 162/17; 162/41; 162/57; 162/60; 162/237; 210/213

[58] Field of Search ..... 8/156, 158, 159; 68/181 R, 182; 210/213, 397, 414, 415; 162/4, 17, 41, 52, 57, 60, 237, 243, 246, 248, 251

[56] References Cited

U.S. PATENT DOCUMENTS

| | | | |
|---|---|---|---|
| 1,468,337 | 9/1923 | Winestock | 8/156 |
| 1,921,080 | 8/1933 | Hammond | 68/181 R X |
| 1,990,992 | 2/1935 | Lang et al. | 210/415 X |
| 2,649,371 | 8/1953 | Reid | 68/181 R |
| 3,557,583 | 1/1971 | Rich et al. | 68/181 R |
| 3,807,202 | 4/1974 | Gunkel | 68/181 R |

*Primary Examiner*—Richard V. Fisher

*Attorney, Agent, or Firm*—Neuman, Williams, Anderson & Olson

[57] ABSTRACT

A process and apparatus for washing high consistency fibre stock in the de-inking of paper. Grey stock is passed along a passage from a grey stock inlet to an outlet for cleaned stock. The passage is defined by a filter screen preferably of wire gauze. Within the passage is disposed a stirring member. Washing liquid such as water is introduced into the passage preferably by means of apertures in a central portion of the stirring member. Effluent liquid passes through the screen for extraction through a suitable outlet, or for recirculation. The arrangement is such that relative rotation of the screen and member results in clusters of stock fibres, which move around the passage as they pass therealong. The stirring member preferably includes a plurality of longitudinally extending, axis parallel bars radially spaced from the central portion.

12 Claims, 2 Drawing Figures

PROCESS AND APPARATUS FOR WASHING FIBRE STOCK IN THE DE-INKING OF PAPER

Figure 1:
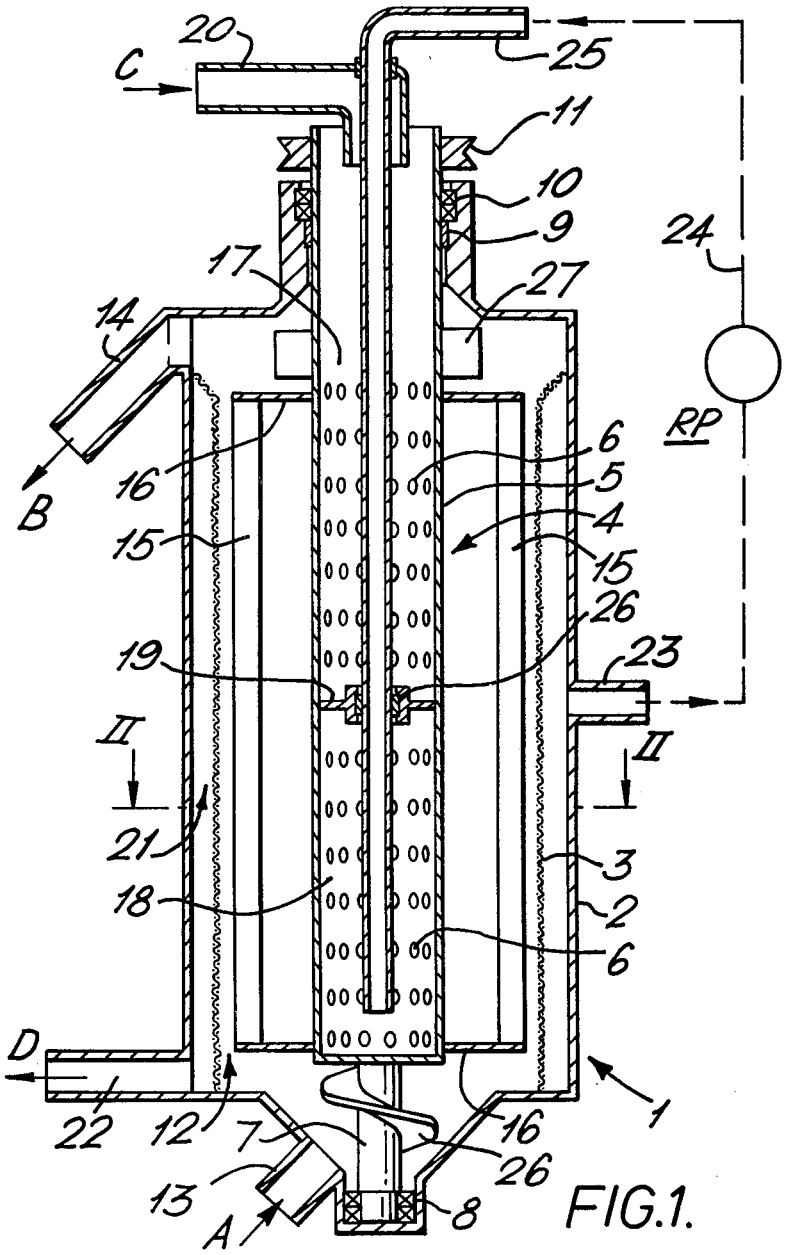

This invention relates to a process and apparatus for washing fibre stock in the de-inking of paper.

The salvage and re-use of waste paper, in particular printed waste paper, is of considerable importance for both ecological and financial reasons. Thus salvage and re-use are of value in preserving natural resources and, if the operations are performed efficiently, can generate stock for use in paper manufacture less expensively than it can be obtained from natural sources.

A conventional de-inking process involves a number of steps. Thus, the waste may first be pulped with suitable chemicals in dilute aqueous solution, and extraneous material such as pieces of metal and plastics removed, to produce fibre stock. The stock is then cleaned, to produce what is commonly known as "grey stock." At this stage, ink particles will be in suspension. Finally, ink is removed from the stock by a washing or flotation method.

A conventional flotation technique involves the use of stock at consistencies no higher than 1%, although some systems may be capable of handling consistencies of up to 2%. This relatively low consistency requirement, coupled with the slow rate of ink removal by flotation, means that these techniques have several disadvantages.

In a conventional washing technique, the stock is diluted with e.g. clean water to a consistency of say 1%, and water containing suspended ink particles is then filtered off. However, as the stock thickens, and reaches for example a consistency of say 3–4%, it begins to exert a filtering action itself, retaining ink particles so that only clean water is drained off. This internal filtering reduces the efficiency of washing. Thus is proves necessary to re-dilute and re-drain the stock. Several repetitions of the washing technique are necessary before the stock attains the desired degree of brightness. The result is that large volumes of washing water are required, and that the capital expenditure on equipment for the several stages can be high.

A further problem arises in that fibres from the stock tend to block filter screens and the like during the washing process, so that once again the efficiency is reduced and it may be necessary to clean the screens at frequent intervals. This problem will of course be more serious the higher the stock consistency.

U.S. Pat. No. 1,921,080 discloses apparatus for washing stock in which the stock is passed along a perforated cylinder by means of a screw conveyor, water being supplied through apertures in the conveyor shaft. This causes thorough agitation of the stock. Fibres will however collect in the perforations and means are specifically provided to clean the perforations. This involves the use of additional fluid. It is unlikely that this apparatus could efficiently wash stock of high consistency.

There would be advantages in a capability to wash stock effectively at high consistencies of say, up to 7%. The volumes of washing water required would be reduced; chemicals could be used more effectively since they would not be diluted with unnecessarily high volumes of water; and there would be reduced requirements for the thickening of de-inked stock before any subsequent stages, such as bleaching if necessary. On the other hand, the above-mentioned problems of ink retention and filter screen blockage would be all the more serious.

It is therefore the aim of the invention to provide a process and apparatus with the capability of washing stock of relatively high consistencies whilst at least substantially reducing the above-mentioned problems.

According to one aspect of the invention, there is provided a process for washing fibre stock in the de-inking of paper, wherein the stock is passed along a passage from a stock inlet to a stock outlet, at least a portion of the passage being defined by a filter screen, and a longitudinally extending stirring member being disposed in the passage; washing liquid is introduced into the passage at least in a region remote from the stock inlet, effluent liquid passing through the filter screen; and relative rotary movement is effected between the filter screen and stirring member such that stock fibres move around the passage in clusters as they pass therealong towards the stock outlet.

We have found that by forming clusters of fibres, efficient removal of ink particles can be obtained, whilst blocking of the filter screen to any substantial extent can be avoided. In a conventional process there will be a relatively even dispersion of fibres. It is then easy for these to settle on the filter screen, causing blockages; there may also be fibre loss through the screen. In accordance with the invention, although a solid web of stock will not build up to prevent flow through the passage, the fibres are not so dispersed that screen blockage and fibre loss will be substantial problems.

It has been found that in practice, a plug of high consistency stock, e.g. 10–12%; may form at the inlet. This can be broken up into the fibre clusters by the stirring member or by other means. These clusters may move round the passage in a rolling fashion.

The velocity of the fibre clusters in relation to the filter screen should be relatively low, for example of the order of 0.5–3 $ms^{-1}$ for stock consistencies of 2.5–6%. This will prevent the stock being agitated to such an extent that an even dispersion of fibres results. Furthermore, centrifugal de-watering of the input stock may be avoided; this could cause blockages by the formation of unwanted high consistency plugs of stock.

To maintain a low velocity, it may be desirable for the filter screen to be in the form of a wire mesh rather than a perforated rigid screen, although a mesh-lined rigid screen might be satisfactory. There will tend to be higher frictional forces between a mesh and the stock, which will restrict the rate of stock rotation. The filter screen could be in the form of a cylinder.

The introduction of washing liquid at least in a region remote from the stock inlet may result in the clean liquid flowing in a generally counter-current direction to the stock. Preferably, washing liquid is introduced along the length of the passage, so that stock therein is constantly contacted with e.g. wash water. This may reduce unevenness of stock consistency. The stock is preferably urged along the passage by the pressure of incoming stock. It might in some instances be possible to employ a screw conveyor in the passage, although this will encourage longitudinal mixing of the stock, causing a drop in efficiency and less clean stock at the outset. Short flights of screw conveyor adjacent the inlet and outlet might though be used e.g. to break up high consistency plugs forming in these regions and generally assist plug flow.

The stirring member should accordingly be desirably of such a design that there is the minimum longitudinal mixing of stock in the passage, whilst there can be radial diffusion of liquid containing suspended ink particles. There will be a maximum efficiency when there is no mixing of washing liquid with effluent as it passes through the filter screen.

As the stock advances through the passage, it becomes progressively cleaner until it reaches the outlet. Washing fluid containing suspended ink particles which have passed through the filter screen, leaves through a suitable outlet, and may if required be re-circulated.

During the movement of the stock through the passage—which is advantageously vertically disposed, the concentration of ink in the stock falls off approximately exponentially. The particles of ink, and any other particles such as clay (which may have a size about 2–10 micron) pass through the filter screen. This may have apertures of about 100 micron for example, so that the large, wanted fibres are retained. A facility to filter off clay particles is advantageous in handling clay filled paper, such as "glossy" magazines.

It may be desirable to set up a consistency gradient in the passage. Thus grey stock may be introduced at about 3 or 5% consistency, and cleaned stock removed at, say, 5½–6½% consistency. This could be achieved by extracting more effluent liquid than washing liquid is added.

The stirring member advantageously consists of a central body portion and a plurality of longitudinally extending elements e.g. bars spaced radially from the central body. Such an arrangement may be termed a "gate stirrer." The elements may pass close to the interior surface of the filter screen, for example being spaced 1 to 2 mm therefrom. In addition to promoting the formation and/or maintenance of clusters which move round the stirring member, the longitudinal elements may, if desired set up pulsations. Gentle stirring of stock in the region of the mesh may result in the creation of a zone of raised pressure in front of an elements and a zone of reduced pressure behind it. The resultant pulsations may assist the flow of effluent through the filter screen, and assist in preventing a blocked screen. The gate stirrer does not however produce substantial longitudinal mixing.

The stirring member acts generally to keep the stock in constant motion. It is advantageously the stirrer which rotates, rather than the screen, since the latter arrangement might provide insufficient movement of the stock, depending on the frictional effect between the screen and the stock. The speed of rotation of the stirring member could be, say, 10–100 RPM.

Preferably, clean washing liquid is admitted to the passage at a number of locations along the length thereof, preferably substantially along the entire length of the passage along which stock will travel. The clean liquid could for example be admitted through apertures in the stirring member, communicating with a hollow interior thereof.

According to a preferred embodiment of the invention, an effluent outlet is arranged so as to permit the withdrawal of effluent liquid from a location close to the stock inlet. The apparatus may then include recirculation means by which some of the effluent liquid may be withdrawn from a point intermediate along the length of the passage and re-introduced to the passage as relatively clean liquid for washing stock, at a location between the point at which this recirculated liquid was withdrawn and the stock inlet. Conveniently effluent liquid for recirculation may be withdrawn from about half-way along the passage. The concentration of suspended ink particles in the effluent liquid is very much greater in the region close to the stock inlet than in the region close to the stock outlet. Thus effluent liquid drained from about half-way along the passage is relatively clean and may be used in place of clean liquid for washing stock as it passes through the first half of the passage. An advantage of this arrangement is that it enables one to reduce by about one-half the quantity of washing liquid used in operation of the apparatus. The return of comparatively clean effluent liquid from a later section of the passage to an eariler section may be carried out in several stages if desired.

To effect recirculation, with washing liquid being supplied through a hollow central portion of a stirrer, this central portion may be divided into first and second chambers, the first chamber communicating with a section of the passage extending from the stock inlet to an intermediate point and the second chamber communicating with the passage from the said intermediate point to the stock outlet. Clean washing liquid enters the passage through the second chamber and mingles with the stock. This liquid then passes through the filter screen to become effluent liquid containing a relatively low concentration of suspended ink particles. This effluent liquid then passes through a recirculation system to re-enter the passage through the first chamber where it mingles with stock which is in the early stage of its travel through the apparatus. The liquid passes through the filter screen to become effluent liquid containing a relatively high concentration of suspended ink particles and is disposed of accordingly.

The passage through which the stock is passed is desirably disposed vertically. Means may be provided in the region of the stock outlet to assist its removal—for example an impeller or like device.

The filter screen, e.g. in the form of a cylinder, is preferably disposed around the outside of the stirring member, thereby forming the outer wall of the passage. It might however be advantageous to have the alternative arrangement in which the stirrer is arranged around the filter screen, which would then define the inner wall of of the passage. In the latter case, the outer wall could also be defined by a second filter screen for the removal of effluent. In the event that the stirring member passes between two walls, e.g. in the above-mentioned possibility, it may be advantageous to supply washing liquid through suitable stirrer elements in the passage—e.g. longitudinal bars. A plurality of e.g. cylindrical filter screens could be arranged coaxially to define a plurality of coaxial passages disposed around each other, each of which would then be provided with suitable stirring means.

The invention also extends to apparatus for carrying out the above described processes, and thus viewed from another aspect provides apparatus for washing fibre stock, comprising a passage along which the stock is to be passed from a stock inlet to a stock outlet, at least a portion of the passage being defined by a filter screen, a longitudinally extending stirring member disposed in the passage, means for introducing washing liquid into the passage at least in a region remote from the stock inlet, means for extracting effluent liquid which has passed through the filter screen, and means for effecting relative rotary movement between the filter screen and stirring member, the arrangement being such that in use stock fibres move around the passage in clusters as they pass therealong towards the stock outlet.

As mentioned above, it has been found that in the washing of stock, a "gate" stirrer is of particular advantage. Apparatus including a similar type of structure, i.e. a plurality of longitudinally extending bars or the like, is disclosed in U.S. Pat. No. 1,990,992. In the apparatus described therein, however, water jets mounted on the bars are used to clean the wire mesh of slime which settles thereon. Separation of slime and fibres is primarily by the action of centrifugal forces. Such apparatus would be unsuitable in the de-inking of stock, particularly high consistency stock.

Viewed from a further aspect, therefore, the invention provides apparatus for washing fibre stock in the de-inking thereof, comprising a passage along which the stock is to be passed from a stock inlet to a stock outlet, at least a portion of the passage being defined by a cylindrical filter screen, means supporting a plurality of circumferentially spaced, axis-parallel longitudinally extending stirring elements within said passage, means for rotating said stirring elements about the axis of the passage, means for introducing washing liquid into the passage at least in a region remote from the stock inlet, and means for extracting effluent liquid which has passed through the filter screen, wherein the means for introducing washing liquid is arranged so that such liquid can pass through the bulk of stock in the passage in use of the apparatus.

By this means, removal of ink particles is effected by the passage of liquid through the stock. On the other hand, in U.S. Pat. No. 1,990,992, separation is by centrifugal action, and the water sprays do not pass liquid through the bulk of stock, but only impinge on the filter screen. This latter arrangement is unlikely to be suitable for de-inking, particularly of high consistency stock.

Figure 2:
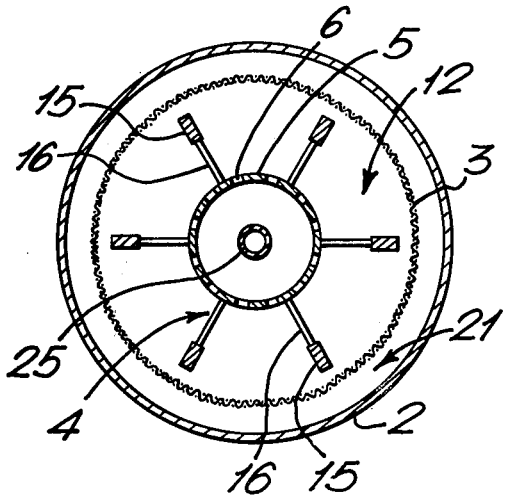

An embodiment of the invention will now be described by way of example and with reference to the accompanying drawing in which:

FIG. 1 is a diagrammatic vertical section through apparatus in accordance with the invention and, FIG. 2 is a horizontal section on the line II—II of FIG. 1.

Referring now the the drawings, the apparatus generally indicated 1 includes a generally cylindrical vertical housing 2 in which is coaxially disposed a cylindrical woven wire mesh 3. Within the cylindrical mesh 3 is coaxially disposed a rotatable stirring member generally indicated 4. The member 4 includes a hollow cylindrical central portion 5 closed at its lower end and provided with a number of apertures 6 along its length. At its lower end the portion 5 terminates in a shaft 7 mounted in bearings 8 in the housing 2. At its upper end the portion 5 passes through a suitable seal 9 and bearings 10 mounted in housing 2. The member 4 is rotatable by means of a pulley 11 secured to portion 5 and driven by a suitable V-belt (not shown). Other drive means—e.g. gears—could be used.

The cylindrical mesh 3 defines a passage 12 through which stock can be passed from an inlet 13 at the bottom of housing 2, in the direction of arrow A, to an outlet 14 at the top of housing 2, in the direction of arrow B.

The stirring member 4 includes six longitudinally extending, axis-parallel bars or like elongate elements 15 mounted on arms 16 so as to be radially spaced from central portion 5, and disposed in passage 12.

The hollow central portion 5 is divided into upper and lower chambers 17 and 18 respectively by a partition 19. An inlet 20 is provided for supplying fresh, clean water (or another suitable washing liquid) in the direction of arrow C on the upper chamber 17, so as to pass through apertures 6 into the passage 12.

Effluent liquid can pass through the mesh 3 into an annular outlet chamber 21 from whence it can be drawn off from outlet pipe 22 in the direction of arrow D. Approximately midway up the outlet chamber 21 is a recirculating outlet 23 for relatively clean effluent. This is passed along a suitable conduit indicated at 24 by means of a pump RP and into a recirculated liquid inlet pipe 25. This pipe passes downwardly inside chamber 17 and through a suitable seal bearing assembly 26 in partition 19, and opens into the lower chamber 18. From here the recirculated liquid can pass through apertures 6 into passage 12.

Mounted at the lower end of the stirring member 4, on shaft 7, is a single flight helical blade 26. At the upper end of the member 4, on central portion 5, is mounted a multi-vane impeller 27.

In use of the apparatus 1, clean water is supplied in a steady flow through inlet 20, and grey stock is supplied through inlet 13. The stirring member 4 is continuously rotated through 360° by means of pulley 11, at a relatively slow rate. The grey stock which enters through inlet 13 is of relatively high consistency, say up to 7%. There may be a tendency for the grey stock to clog the lower end of the housing 2, e.g. by forming a plug of high—e.g. 10–12%—consistency stock. Helical blade 26 assists in maintaining flow however, and breaking up the plug.

As the stock advances upwardly, it is continuously brought into contact with washing water. This water takes up ink particles as a suspension, and passes through the mesh 3 for removal as effluent—through outlet 22 at the lower end of the apparatus. The effluent at the upper end of the apparatus is relatively clean, and is thus recirculated by means of pump RP, for use in washing grey stock at the lower end of the apparatus. As the grey stock advances up the apparatus, under the pressure of stock being fed through the inlet 13 by suitable means such as a pump, the stock becomes progressively cleaner. The cleaned stock is discharged at the top of the apparatus through outlet 14, this being assisted by the action of impeller 27, which tends to propel the stock radially outwardly.

A steady state will be reached with grey stock and clean water being continuously fed to the system, and cleaned stock and effluent water being continuously removed. The stirrer 4 and pump RP will also function continuously.

As the stirrer turns, the fibres in the stock, which originally may be in the form of a fairly high consistency plug, are broken up into clumps or macro-clusters. These tend to roll around the inside of mesh 3 around the axis of stirrer 4. At the same time radial diffusion occurs and ink particles are swept radially outward to and through the mesh by the pressure of water coming from apertures 6.

In this manner, effective ink removal is achieved, whilst blocking of the mesh 3, or fibre loss through the mesh, can be avoided. The apparatus is thus capable of continuously de-inking grey stock.

According to the quality of stock required, the various parameters such as flow rates, stirrer speed and so forth may be varied. In general, the brighter the stock required, the longer will be the residence time in the apparatus. Suitable flow meters or the like could be used to monitor operation of the apparatus.

It has been found that apparatus in accordance with the invention may readily be operated at 2 tons or more of fibre per square meter of mesh per day. Thus a 5 square meter mesh will provide adequate supplies without the apparatus being undesirably large.

We claim:

1. A process for washing high consistency fibre stock in the de-inking of paper, wherein the stock is passed along a passage from a stock inlet to a stock outlet, at least a portion of the passage being defined by a filter screen, and a longitudinally extending stirring member being disposed in the passage; washing liquid is introduced into the passage at least in a region remote from the stock inlet, effluent liquid passing through the filter screen; and relative rotary motion is effected between the filter screen and stirring member such that stock fibres roll around the passage in clusters as they pass therealong towards the stock outlet.

2. A process as claimed in claim 1 wherein the stock has a consistency of up to 7%.

3. A process as claimed in claim 2 wherein the stock has a consistency in the range of 2.5 to 6%.

4. A process as claimed in claim 1 wherein a plug of stock is formed adjacent the stock inlet and is broken up into the clusters.

5. A process as claimed in claim 1 wherein the passage is vertically disposed and the stock passes upwardly from the stock inlet to the stock outlet.

6. Apparatus for washing high consistency fibre stock comprising a passage along which the stock is to be passed from a stock inlet to a stock outlet, at least a portion of the passage defined by a filter screen, a longitudinally extending stirring member disposed in the passage, means for introducing washing liquid into the passage at least in a region remote from the stock inlet, means for extracting effluent liquid which has passed through the filter screen, and means for effecting relative rotary movement between the filter screen and stirring member, the arrangement being such that in use stock fibres roll around the passage in clusters as they pass therealong towards the stock outlet.

7. Apparatus for washing high consistency fibre stock in the de-inking thereof, comprising a passage along which the stock is to be passed from a stock inlet to a stock outlet, at least a portion of the passage being defined by a cylindrical filter screen, means supporting a plurality of circumferentially spaced, axis-parallel, longitudinally extending stirring elements within said passage, means for rotating said stirring elements about the axis of the passage, means for introducing washing liquid into the passage at least in a region remote from the stock, and means for extracting effluent liquid which has passed through the filter screen, wherein the means for introducing washing liquid is arranged so that such liquid can pass through the bulk of stock in the passage in use of the apparatus, the arrangement being such that in use stock fibres roll around the passage in clusters as they pass therealong towards the stock outlet.

8. Apparatus as claimed in claim 7, wherein means are provided for extracting effluent liquid which passes through the filter screen in a region extending from the stock outlet to a point intermediate along the passage, and for recirculating such liquid to a region extending from said intermediate point to the stock inlet, as washing liquid for stock therein.

9. Apparatus as claimed in claim 7 wherein means are provided for introducing washing liquid along substantially the entire length of the passage.

10. Apparatus as claimed in claim 7 wherein the filter screen comprises wire gauze.

11. A process for continuously washing high consistency fibre stock in the de-inking of paper, wherein the stock is passed into and along a passage from a stock inlet to a stock outlet, at least a portion of the passage being defined by a filter screen, and a longitudinally extending stirring member being disposed in the passage; washing liquid is introduced into the passage at locations spaced longitudinally therein, the water passing through the stock and the resultant effluent liquid containing particles of ink passing through the filter screen; and relative rotary motion is effected between the filter screen and stirring member such that clusters of fibres are formed and roll around the passage as they pass therealong to the stock outlet, without an even dispersion of fibres being produced.

12. Apparatus for washing high consistency fibre stock comprising a cylindrical filter screen, a stock inlet communicating with one end of said filter screen, a stock outlet communicating with the other end of said filter screen, means for passing high consistency stock into and along said filter screen from said inlet to said outlet, a longitudinally extending stirring element disposed within said filter screen, and displaced radially from the axis thereof, means for effecting relative rotation between said stirring element and said screen about the axis thereof such that clusters of stock fibres roll around the axis of said screen as they pass therealong, means for introducing washing liquid into the interior of said screen in a central region thereof for passage through the stock towards the screen, and means for extracting effluent liquid which passes through the screen.

* * * * *